United States Patent [19]

Kato et al.

[11] 4,288,720

[45] Sep. 8, 1981

[54] METHOD OF ERASING INFORMATION IN A SCAN CONVERTER STORAGE TUBE

[75] Inventors: Takefumi Kato, Hinode; Haruo Abe, Hino, both of Japan

[73] Assignee: Iwatsu Electric Co., Ltd., Tokyo, Japan

[21] Appl. No.: 82,144

[22] Filed: Oct. 5, 1979

[30] Foreign Application Priority Data

Oct. 9, 1978 [JP] Japan ..... 53-124376

[51] Int. Cl.[3] ..... H01J 29/50; H01J 31/00

[52] U.S. Cl. ..... 315/13 ST; 328/124

[58] Field of Search ..... 315/13 ST, 8.5; 358/11, 358/140; 328/124; 313/391, 392, 394

[56] References Cited

U.S. PATENT DOCUMENTS 3,748,585 7/1973 Culter et al. ..... 313/392

*Primary Examiner*—Theodore M. Blum

[57] ABSTRACT

A method for ready and thorough erasure of information in a scan converter storage tube of the class including an electron gun of an electrostatic focus and deflection variety and a storage target having a substrate made from sapphire or like monocrystalline insulator. The storage surface of the substrate is first primed by a scanning electron beam from the electron gun while the potential of a collector electrode on the storage surface is set higher than the value which is lower than the potential of the field mesh electrode of the electron gun by up to about 100 volts. Then the storage surface is again scanned after setting the collector electrode potential higher than the potential of the cathode included in the electron gun and at such a value that the storage surface potential with respect to the cathode potential becomes less than a potential at which the secondary emission ratio of the monocrystalline substrate first becomes unity. Thus, as the storage surface acquires the cathode potential as a result of the scanning, a prewrite potential difference is established between storage surface and collector electrode.

6 Claims, 8 Drawing Figures

METHOD OF ERASING INFORMATION IN A SCAN CONVERTER STORAGE TUBE

BACKGROUND OF THE INVENTION

1. Field of the Invention

Our invention pertains to a method of erasing or deliberately removing information from the storage target of a scan converter storage tube. The storage target for use with the method of our invention is of the type having a substrate fabricated from a single crystal of electrically insulating material such as, typically, sapphire. The storage target of this character is described and claimed in Takefumi Kato et al. copending U.S. patent application Ser. No. 890,495, "Storage Target for Scan Converter Tubes," filed on Mar. 27, 1978 and assigned to the instant assignee.

2. Description of the Prior Art

Scan converter storage tubes of various constructional and operational characteristics have been suggested and used for the storage, and later extraction, of data such as pictures and high-speed electrical signals. The storage target in a typical one (shown in FIG. 1 of the accompanying drawings) of such prior art scan converter storage tubes includes a silicon dioxide ($SiO_2$) storage layer in the form of stripes or lands on one surface of a silicon substrate, on the opposite surface of which is a conductive backplate or a backing electrode. Alternatively the storage target as heretofore constructed includes a layer of collector electrode, having a set of regularly patterned openings formed therein, overlying a glass substrate.

This type of scan converter storage tube permits the storage (writing) of information in the form of an electric charge pattern and the nondestructive extraction (reading) of the information. The storage tube effects writing by taking advantage of the emission of secondary electrons from the $SiO_2$ storage layer or from the glass substrate. The secondary emission ratio of the $SiO_2$ storage layer or of the glass substrate, therefore, limits the writing speed of the storage tube, up to the order of several megahertz in terms of frequency. For this reason the conventional storage tube with its storage target of the noted constructions has not permitted the writing of rapidly changing phenomena or irregular or intermittent high-frequency signals, restricting its use to the storage of pictures that can be written at comparatively low speed.

The electromagnetic deflection of the electron beam in the prior art scan converter storage tube in question has also set a limit on its writing speed. Even were it not for this additional limitation, however, the secondary emission ratio of the conventional storage target would by itself keep the writing speed as low as several megahertz.

With a view to eliminating the above drawback of the prior art, the aforementioned U.S. patent application Ser. No. 890,495 proposed the improved storage target whose substrate was made of a single crystal of insulating material. As has later proved, however, a scan converter storage tube incorporating this improved storage target does not allow effective erasure of the stored information by the conventional method. A brief explanation follows on this conventional erasing method.

The various parts of the electron gun included in the storage tube are first set at appropriate working potentials. For example, the cathode may be set at ground potential, the control grid at −75 through 0 volt (V), the acceleration electrode at 350 V, the collimation electrode at 300 V, and the field mesh electrode at 650 V.

As the first step of erasure, aimed at priming the storage target, the electron gun bombards or scans the complete target surface with an unmodulated electron beam. In this first step a voltage of, for example, 300 V is impressed to the collector electrode of the storage target so that the potential of the storage surface of the target substrate may exceed a "first crossover potential" at which the secondary emission ratio of the substrate first becomes unity.

The second step of erasure aims at establishment of a "prewrite" or "erase" potential difference between collector electrode and storage surface, preparatory to the subsequent writing process. In this second step the storage target is again scanned with the unmodulated beam from the electron gun, this time with the application to the collector electrode of a voltage (e.g., 10 V) such that the storage surface potential may become less than the first crossover potential. As has been mentioned, this conventional erasing method does not enable ready, complete erasure of information when applied to the improved storage target.

With the conventional erasing method applied to the conventional storage target, the storage surface potential does become higher than the first crossover potential upon application of 300 V to the collector electrode. When struck with the unmodulated priming beam, therefore, the storage surface assumes the same potential (i.e., 300 V) as the collector electrode. The complete storage surface thus acquires the uniform potential regardless of whether or not information has been stored thereon.

In the subsequent second step of the conventional erasing method the storage surface potential is made less than the first crossover potential of the substrate. Thus the electron bombardment of this storage surface makes its potential equal to the cathode potential (i.e., 0 V). The result is the establishment of the desired 10 V prewrite potential difference between storage surface and collector electrode, with the 10 V charge on the storage member of the target.

The following seems to us the most reasonable explanation for the fact that the above conventional method of erasure is not applicable to the improved storage target of the mentioned copending U.S. application with any favorable results. In the noted first step of the conventional method the potential of the field mesh electrode is set considerably higher than that of the collector electrode. Upon electron bombardment of the storage surface, therefore, the secondary electrons excited therefrom are captured not only by the collector electrode but also by the field mesh electrode. The result of this is the higher potential of the storage surface than that of the collector electrode. The storage surface retains this high potential because it is of a monocrystalline insulator and so is highly insulating.

Let Vp be the difference between storage surface potential Vs and collector electrode potential Vc after the scanning of the storage surface with the priming beam. Then Vs approximately equals the sum of Vc and Vp. The storage surface potential is higher as aforesaid than the collector electrode potential.

In the second step of the conventional method the collector electrode potential with respect to the cathode potential is to be set lower than the first crossover potential in order to make the storage surface potential less than the first crossover potential. For the above stated reason, however, the storge surface potential actually does not become less than the first crossover potential if the collector electrode potential is set as above. With the storage surface potential being thus held higher than the first crossover potential, the electron bombardment of the storage surface fails to make its potential equal to the cathode potential.

SUMMARY OF THE INVENTION

Our invention aims, therefore, at the provision of a method of readily and positively erasing information in a scan converter storage tube of the type having a storage target whose substrate is fabricated from a single crystal of insulating material.

The method of our invention is intended for application to a scan converter storage tube of the class comprising an electron gun of an electrostatic focus and deflection type for generating a modulated or unmodulated electron beam, and a storage target to be scanned by the electron beam from the electron gun. The electron gun includes at least a cathode and a field mesh electrode. The storage target includes a substrate made from a single crystal of insulating material, and a collector electrode formed on the storage surface of the substrate which is disposed opposite to the field mesh electrode, with the collector electrode having a plurality of regularly patterned openings formed therein.

For erasing information from the storage target of the scan converter storage tube outlined above, the inventive method proposes to scan the storage surface of the substrate with the unmodulated electron beam from the electron gun while the potentials of the field mesh electrode and the collector electrode are set at such relative values that the collector electrode potential is higher than the value which is lower than the field mesh electrode potential by up to about 100 V. Then the storage surface of the substrate is again scanned with the unmodulated electron beam, this time with the collector electrode potential set higher than the potential of the cathode and at such a value that the storage surface potential with respect to the cathode potential is made less than a first crossover potential at which the secondary emission ratio of the substrate first becomes unity.

The first step of beam scanning according to the invention method is intended to prime the storage surface of the substrate. The second step of scanning is aimed at establishment of the prewrite potential difference between storage surface and collector electrode by way of preparation for the subsequent writing process.

In the above priming step the collector electrode potential is set higher than the value which is lower than the field mesh electrode potential by up to about 100 V. Preferably the collector electrode potential is set higher than the field mesh electrode potential itself. In this manner the field mesh electrode is more or less restrained from capturing the secondary electrons emitted from the storage surface, so that the potential of the primed storage surface does not become unnecessarily high.

Thus, in subsequently creating the prewrite potential difference between storage surface and collector electrode, the storage surface potential with respect to the cathode potential can be made less than the first crossover potential of the substrate. The storage surface potential thus becomes equal to the cathode potential when scanned with the unmodulated beam.

The above and other objects, features and advantages of our invention and the manner of attaining them will become more readily apparent, and the invention itself will best be understood, from the following detailed description taken in connection with the accompanying drawings.

DETAILED DESCRIPTION OF THE INVENTION

Figure 1:
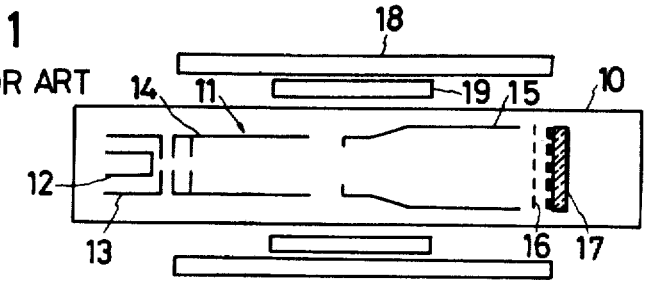
FIG.1 PRIOR ART
FIG. 1 is a schematic axial sectional view of a prior art scan converter storage tube.

The prior art scan converter storage tube shown in FIG. 1 is of the familiar electromagnetic focus and deflection type. The storage tube includes a vacuum envelope 10 within which there is mounted in electron gun 11 comprising a cathode 12, control rigid 13, acceleration electrode 14, collimation electrode 15, and field mesh electrode 16. A storage target 17 is also mounted within the envelope 10 adjacent one axial end thereof. The storage tube further comprises a focusing coil 18 and a deflection coil 19, both mounted externally of the vacuum envelope 10 in concentric relationship thereto.

The storage target 17 of the prior art storage tube has a storage layer of $SiO_2$ formed as stripes or lands on a silicon substrate having a backing electrode. An alternative form of the conventional storage target is such that a sheet of collector electrode, having formed therein a regularly arranged set of openings of strip-like, hexagonal, square, rectangular, circular or other shape, is formed on a glass substrate. This known type of scan converter storage tube has the disadvantages and limitations pointed out earlier in this specification.

Storage Tube Construction

Figure 2:
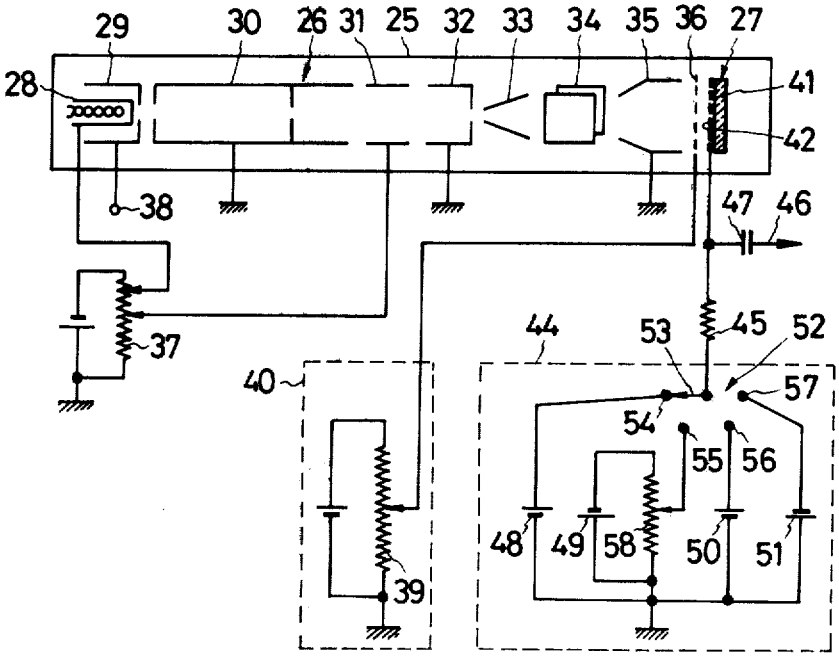
FIG. 2 is a schematic axial sectional view of an example of scan converter storage tube suitable for use with the method of our invention.

FIG. 2 shows in axial section a schematic arrangement of the scan converter storage tube suitable for use with the erasing method of our invention. The storage tube includes a hermetically sealed, tubular vacuum envelope 25. Housed in this vacuum envelope 25 is a modulatable electron beam gun 26 of an electrostatic focus and deflection variety. The vacuum envelope 25 also contains, adjacent one axial end thereof, a storage target 27 to be bombarded or scanned by the electron beam, which may be modulated or unmodulated, from the electron gun 26.

The electron gun 26 comprises a cathode 28, a control grid 29, an acceleration electrode 30, a focusing electrode 31, an astigmatizer electrode 32, a pair of vertical deflection plates 33, a pair of horizontal deflection plates 34, a collimation electrode 35, and a field mesh electrode 36. All the listed components of the electron gun 26 are arranged sequentially along the axis of the vacuum envelope 25.

The cathode 28 of the electron gun 26 is connected to a potentiometer 37 for the application of, for example, −100 V to the cathode. Intended to control the emission of the electron beam, the control grid 29 has a terminal 38 to which there is impressed a voltage of, for example, −75 to 0 V with respect to the cathode potential. In the prime, erase and read modes of operation the electron gun 26 must generate an unmodulated electron beam, so that the control grid 29 is then impressed with a voltage permitting the generation of the unmodulated electron beam. In the write mode, however, the control grid receives a signal for modulating the electron beam.

FIG. 2 shows the acceleration electrode 30, astigmatizer electrode 32 and collimation electrode 35 as being grounded. The focus electrode 31 is shown to be connected to the potentiometer 37 so as to set the same at, for example, −800 V.

Acting to accelerate the electron beam toward the storage target 27, the field mesh electrode 36 is connected to another potentiometer 39 forming its supply circuit 40. The potentiometer 39 permits adjustably varying the voltage applied to the field mesh electrode 36. If this is unnecessary, however, a constant voltage of, for example, 1400 V may be impressed to the field mesh electrode 36 from a suitable supply circuit connected in place of the potentiometer 39.

Figure 3:
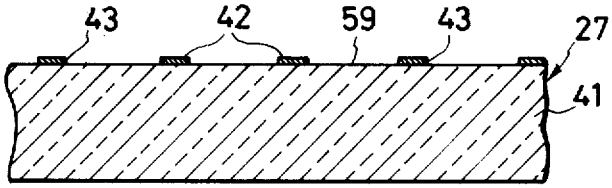
FIG. 3 is a fragmentary, enlarged sectional view of the storage target used in the scan converter storage tube of FIG. 2.

As shown on an enlarged scale in FIG. 3, the storage target 27 comprises a substrate 41 fabricated from a single crystal of electrically insulating material, and a collector electrode 42 formed on and in close contact with the substrate surface oriented opposite to the field mesh electrode 36 of the electron gun 26. The collector electrode 42 has a multiplicity of identical openings 43 formed therein in regular arrangement. More will be said presently about this storage target 27.

With reference back to FIG. 2 the collector electrode 42 of the storage target 27 is connected to a collector voltage supply circuit 44 via a resistor 45 on the one hand and, on the other hand, to a signal output line 46 having a capacitor 47. The collector voltage supply circuit 44 includes a first power supply 48 for the prime mode, a second power supply 49 for the erase mode, a third power supply 50 for the write mode, and a fourth power supply 51 for the read mode. Also included is a collector voltage selector switch 52 comprising a movable contact 53 connected to the resistor 45, and four fixed contacts 54, 55, 56 and 57 connected to the four power supplies 48, 49, 50 and 51 respectively. The collector voltage selector switch 52 thus serves to selectively connect the four power supplies to the collector electrode 42 of the storage target 27.

In this particular storage tube the fixed contact 55 of the collector voltage selector switch 52 is connected to the erase mode power supply 49 via a potentiometer 58 to enable changes in the required difference (prewrite potential difference) between collector electrode potential and storage surface potential to be created in the erase mode. Thus, if the prewrite potential difference need not be varied, the potentiometer 58 may be omitted, and the fixed contact 55 may be connected directly to the erase mode power supply 49. The provision of the four power supplies for the respective operating modes is also not of absolute necessity. The voltages required in the four operating modes may be derived from one and the same potentiometer.

The substrate 41 of the storage target 27 is required not only to emit secondary electrons, but also to generate hole-electron couples, in response to incident primary electrons. The holes and electrons are further required to be of long lifetime. The storage target substrate 41 to meet all these requirements is fabricated, preferably, from a rhombohedral single crystal of aluminum oxide ($Al_2O_3$), sapphire, that has a purity of at least 99.9%, preferably 99.999% or more, a dislocation concentration of 0 to $10^5$ per square centimeter ($cm^2$), a resistivity of at least $10^{14}$ ohm-centimeters at room temperature, and a crystal energy of at least $10^4$ kilocalories per mol.

Fabricated from such sapphire, the storage target substrate 41 exhibits, in response to an incident electron beam, "conduction" within itself, or the drift of the hole-electron couples generated within the insulator, thus affording a higher writing speed and a greater amplifying effect. Although sapphire is anisotropic, any face orientation is possible. Particularly desirable, however, are R ($1\bar{1}02$), A ($10\bar{1}0$) and C (0011) faces. The storage target substrate 41 may be made from the single crystals of other insulators such as, for example, those of spinel ($MgAl_2O_4$) and magnesium oxide (MgO), which are both of regular crystal system.

The collector electrode 42 of the storage target 27 is formed by evaporation or sputtering of chromium on the storage surface 59 of the substrate 41, which storage surface is oriented opposite to the field mesh electrode 36 of the electron gun 26. Its thickness is not more than about one micrometer (μm). The collector electrode openings 43 of this particular storage target 27 take the form of fine stripes having a constant width and constantly spaced from each other. For the utmost storage ability the ratio of the total surface area of the collector electrode 42 to the total exposed area of the storage surface 59 should be in the range of from about 0.1 to 0.4, and the pitch of the striped collector electrode 42 should be in the range of from about 10 to 50 μm.

The collector electrode openings 43 may not necessarily be in the form of stripes but may, for example, be hexagonal, square, rectangular, circular, etc., in shape. The collector electrode 42 itself may be of metals other than chromium or of a semiconductor providing a desired degree of conduction.

EXAMPLE I of the Inventive Method

The following is the operational description of the scan converter storage tube constructed as in FIGS. 2 and 3, including the description of the first example of the erasing method according to our invention. In the use of this storage tube the cathode is assumed to be set at −900 V; the control grid 29 at −75 to 0 V with respect to the cathode potential; the acceleration electrode 30, astigmatizer electrode 32 and collimation electrode 35 at ground potential; the focusing electrode 31 at −800 V; and the field mesh electrode 36 at 1400 V, all by way of example. The collector electrode 42 of the storage target 27 is to be set at various potentials required in the prime, erase, write and read modes of operation.

In the prime mode, which may be thought of as a step preparatory to the subsequent erase mode or as the actual first step of erasing operation, the movable contact 53 of the collector voltage selector switch 52 is engaged with the fixed contact 54 as shown in FIG. 2, thereby connecting the storage target collector electrode 42 to the prime mode power supply 48. There is thus applied to the collector electrode 42 a voltage of, for example, 1450 V (2350 V with respect to the noted cathode potential). The potential Vc thus applied to the collector electrode 42 (hereinafter referred to as the collector potential) must be higher than the value which is lower than the potential Vm of the field mesh electrode 36 (hereinafter referred to as the field mesh potential) by up to about 100 V.

Symbolically, $Vc > Vm - 100$. Since the field mesh potential Vm is now assumed to be 1400 V, $Vc > 1400 - 100 = 1300$.

Preferably the collector potential Vc should be higher than the field mesh potential Vm. With the collector potential Vc set so high, the collector electrode 42 will capture nearly all of the secondary electrons emitted from the surface 59 of the target substrate 41. The priming operation is possible, however, even if the collector potential Vc is lower than the field mesh potential Vm by up to about 100 V.

The foregoing three paragraphs have been devoted to the lower limit of the collector potential Vc in the prime mode. Its upper limit, then, is the maximum possible voltage that can be applied to the collector electrode 42 without causing the breakdown of the storage target or of any other part associated therewith. Thus, for example, the collector potential Vc may be as high as 20,000 V.

Upon setting of the collector electrode 42 at the priming potential (e.g., 1450 V) as above, an unmodulated electron beam is directed against the storage surface 59 of the target substrate 41 so as to scan its entire areas. For thus bombarding the complete surface of the storage target 27 the cathode 28 is made to emit a beam of electrons, with the control grid 22 maintained at a potential permitting the emission of the electron beam. Focused by the focusing electrode 31, the electron beam is then deflected by the vertical deflection plate pair 33 and the horizontal deflection plate pair 34, for scanning the complete surface of the storage target 27 along a raster or a predetermined pattern of scanning lines as in an ordinary television set. One cycle or frame of such raster scanning normally suffices, but two consecutive scanning cycles is preferred for more positive priming.

Figure 4:
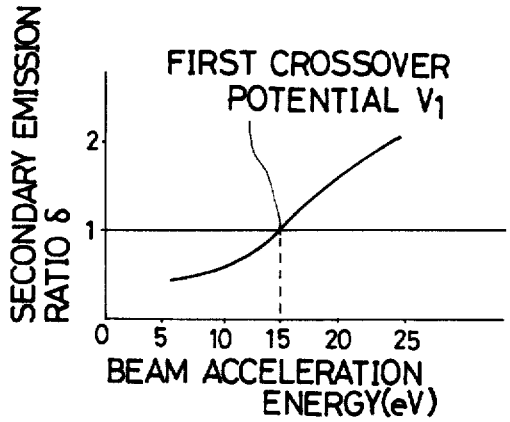
FIG. 4 is a graphic representation of the secondary emission ratio of the substrate of the storage target of FIG. 3 versus beam acceleration energy.

FIG. 4 plots the curve of the secondary emission ratio $\delta$ (the average number of secondary electrons per incident primary electron) of the sapphire substrate 41 against the beam acceleration energy (the storage target or collector potential with respect to the cathode potential) in electron volts (eV). The graph indicates that the secondary emission ratio first becomes unity (i.e., the curve crosses the line where $\delta = 1$) when the beam acceleration energy is 15 eV. The first crossover potential V1 of this sapphire substrate 41 is therefore 15 V.

As has been stated, a voltage of 1450 V (2350 V with respect to the cathode potential) is applied to the collector electrode 42, which overlies the substrate 41 having such a low first crossover potential V1. Thus, even if a charge pattern of 0 to 10 V has been present on the storage surface 59 prior to priming, its potential Vs with respect to the cathode potential Vk becomes higher than the first crossover potential Vl. In this prime mode, therefore, the storage surface 59 is subjected to the unmodulated beam bombardment with its secondary emission ratio made higher than unity.

The collector potential Vc is now assumed to have been set higher than the field mesh potential Vm. Consequently the field mesh electrode 36 substantially does not capture the secondary electrons liberated from the storage surface 59; instead, the secondary electrons are either captured by the collector electrode 42 or redistributed over the storage surface 59. The potential Vs of the entire storage surface 59 thus becomes approximately equal to the collector potential Vc. The result is the erasure of the charge pattern, if any, that has been established on the storage surface 59 by writing.

The electron bombardment of the storage target 27 is suspended upon completion of priming. The next step is the creation of the prewrite potential difference Vpw between collector electrode 42 and storage surface 59. Toward this end the movable contact 53 of the collector voltage selector switch 52 is engaged with the fixed contact 55 thereby connecting the collector electrode 42 to the erase mode power supply 49. This applies to the collector electrode 42 a voltage of, for example, −890 V (+10 V with respect to the cathode potential Vk). The scanning of the storage surface 59 with the unmodulated electron beam (erase beam) is then resumed.

Upon application of −890 V to the collector electrode 42 the storage surface potential Vs also becomes approximately −890 V, or +10 V with respect to the cathode potential Vk. Thus the storage surface potential Vs with respect to the cathode potential Vk becomes less than the first crossover potential Vl of the sapphire substrate 41. When scanned with the erase beam, therefore, the storage surface 59 has its potential Vs made equal to the cathode potential Vk of −900 V. Since the collector potential Vc is now −890 V, $Vc - Vs = -890 - (-900) = +10$.

The desired prewrite potential difference Vpw of 10 V is thus established between collector electrode 42 and storage surface 59. This 10 V prewrite potential difference persists even after cessation of the target bombardment with the erase beam.

In the erase mode of operation discussed above, a single scanning cycle with the erase beam normally enables erasure to a practically satisfactory degree. Two or more consecutive scanning cycles, however, will afford more thorough erasure.

Writing is possible with the above obtained prewrite potential difference Vpw of 10 V. In order to make the writing speed sufficiently high, however, the prewrite potential difference may be increased to a value (e.g., 20 V) higher than the first crossover potential Vl of the substrate 41. This objective calls for the following procedure.

The collector potential Vc is first set at, for example, −880 V (+20 V with respect to the cathode potential Vk), with the result that the storage surface potential Vs becomes lower than the collector potential Vc by 10 V. This means that the storage surface potential Vs with respect to the cathode potential Vk is now 10 V, which is lower than the first crossover potential Vl of 15 V.

Then, with the collector potential Vc held at −880 V, the storage surface 59 is again scanned with the unmodulated beam. Consequently the storage surface potential Vs again becomes equal to the cathode potential Vk. The desired higher prewrite potential difference Vpw of 20 V is thus established between collector electrode 42 and storage surface 59 because now Vc = −880 V and Vs = −900 V.

The foregoing procedure attains the increase of the collector potential Vc from 10 to 20 V (with respect to the cathode potential Vk) in one step. If desired, however, the collector potential Vc with respect to the cathode potential may be increased to 20 V through the incremental steps of, for example, 12, 14, 16, and 18 V, with the scanning beam applied to the storage surface 59 in each step. In this manner the storage surface potential Vs will return to the cathode potential Vk upon being scanned in each step, and the desired 20 V prewrite potential difference will be realized as the collector-versus-cathode potential is raised to 20 V in the final step.

An attainment of a still higher value of the prewrite potential difference Vpw is possible through an essentially identical procedure. As will be evident from the foregoing, this procedure involves (1) increasing the collector potential Vc to such an extent at one time that the consequent storage surface potential Vs with respect to the cathode potential Vk is less than the first crossover potential Vl of the target substrate 41, and (2) scanning the storage surface 59 with the unmodulated electron beam after each increase of the collector potential Vc.

According to the inventive method of erasing information in the scan converter storage tube of FIGS. 1 and 2, set forth in detail hereinabove, the collector potential Vc is set higher than, or more or less close to, the field mesh potential Vm in the prime mode. For this reason the secondary electrons emitted from the storage surface 59 of the target substrate 41 are hardly captured by the field mesh electrode 36 but are either captured by the collector electrode 42 or redistributed over the storage surface 59. The storage surface potential Vs thus becomes approximately equal to the collector potential Vc. There is absolutely no possibility of the storage surface potential becoming abnormally higher than the collector potential in the prime mode.

The storage target 27 of the scan converter storage tube now under consideration has the substrate 41 of sapphire, among other single crystal insulators. Although the first crossover potential Vl of this sapphire substrate 41 is as low as 15 V, the storage surface potential Vs can be made equal to the cathode potential Vk by electron beam bombardment in the erase mode, in order to provide the prewrite potential difference Vpw. It is thus possible to readily and uniformly establish the desired value of prewrite potential difference over the complete surface of the storage target 27.

The above described example of the erasing method according to our invention fulfills the requirement, $Vc > Vm - 100$, by setting the field mesh potential Vm at a fixed value of 1400 V (2300 V with respect to the cathode potential), and by applying a higher voltage of 1450 V (2350 V with respect to the cathode potential) to the collector electrode 42, in the prime mode. The fulfillment of this requirement is also possible by setting the field mesh potential Vm at a value lower than its value for the write mode or read mode, as more specifically set forth in the following.

The field mesh potential Vm is set in a range of 0 to 1500 V, preferably 0 to 1400 V, whereas the collector potential Vc is set at 1400 V. The collector potential Vc could of course be suitably selected from the noted range of voltages that can be possibly applied to the collector electrode 42. The storage surface potential Vs with respect to the cathode potential Vk must be higher than the first crossover potential Vl.

What follows is the description of the write mode and read mode of operation, which succeed the erase mode discussed in the foregoing, of the scan converter storage tube shown in FIGS. 2 and 3. Although these modes of operation fall outside the purview of the erasing method according to our invention, nevertheless we believe that their description will serve to further clarify the invention.

For writing data on the storage surface 59 of the target substrate 41, the target 27 is scanned with a modulated electron beam, produced by supplying a signal representative of the desired data to the control grid 29 of the electron gun 26. In this write mode the movable contact 53 of the collector voltage selector switch 52 is engaged with its fixed contact 56 thereby connecting the storage target collector electrode 42 to the write mode power supply 50. The write mode power supply 50 applies to the collector electrode 42 a voltage of, for example, 9100 V (10,000 V with respect to the cathode potential), which is higher than the field mesh potential Vm of 1400 V. Consequently the storage surface potential Vs rises correspondingly, and this potential Vs with respect to the cathode potential becomes higher than the first crossover potential Vl of the target substrate 41.

Thus, in response to the bombardment by the write beam, the written areas of the storage surface 59 assume a potential ranging from about 9090 V (9990 V with respect to the cathode potential) to about 9100 V (10,000 V with respect to the cathode potential), the latter voltage value being equal to the potential of the collector electrode 42.

The unwritten areas of the storage surface 59 (i.e., the areas that have not been bombarded by the write beam), on the other hand, assume a potential (9090 V, or 9990 V with respect to the cathode potential) corresponding to the difference between collector potential Vc (9100 V) and prewrite potential difference Vpw (10 V). The write beam thus establishes on the storage surface 59 a charge pattern with a potential difference ranging from 0 to 10 V with respect to the collector potential.

As has been stated, the substrate 41 of the storage target 27 is of a monocrystalline insulator, preferably sapphire that is as free from impurities and other crystal defects as possible. The bombardment of this target substrate 41 by the write beam results not only in the emission of secondary electrons at a high ratio $\delta$ but also in the production of hole-electron couples within the substrate itself. These hole-electron couples have a long lifetime $\tau$ and high mobility $\mu$, especially if the target substrate 41 is of sapphire of low impurity and other crystal defect concentractions.

Figure 5:
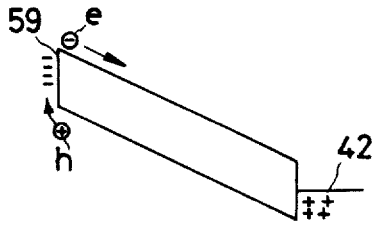
FIG. 5 is a one-dimensional band diagram explanatory of the performance of the storage target of FIG. 3.

Thus, as will be seen from the one-dimensional band diagram of FIG. 5, those hole-electron couples which have been generated within the depth of about one $\mu$m from the storage surface 59 upon bombardment by the write beam are each separated by the electric field. The holes h neutralize the negative charge on the storage surface 59, serving to increase the storage surface potential, whereas the electrons e drift to and are captured by the collector electrode 42. The efficiency with which the collector electrode 42 thus captures the electrons depends not only on the impurity and other defect concentrations of the monocrystalline target substrate 41 (i.e., on the lifetime $\tau$ and mobility $\mu$ of the holes and electrons) but on such additional factors as the shape of the collector electrode 42, the thickness of the target substrate 41, and the potential difference between collector electrode 42 and storage surface 59.

The foregoing will have made clear that the scan converter storage tube of FIGS. 2 and 3 utilize both the secondary emission from the target substrate 41 and the generation of hole-electron couples within the substrate (with consequent conduction therein) for writing. This conduction within the substrate 41 contributes more to the improvement of writing speed than the secondary emission therefrom, especially when the beam acceleration energy is high, as will be better understood upon consideration of FIG. 6.

Figure 6:
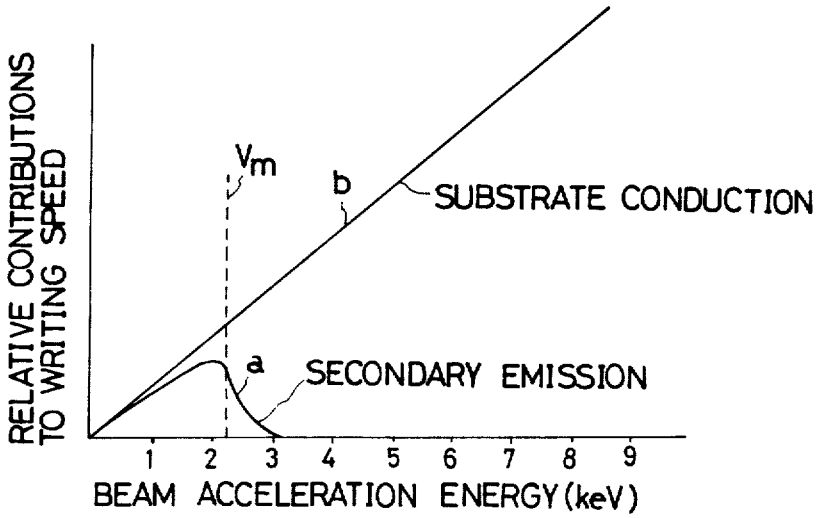
FIG. 6 is a graph explanatory, in the storage target of FIG. 3, of the relative contributions of the secondary emission from the substrate, and of the "conduction" of the substrate due to the hole-electron couples generated therein, to writing speed versus beam acceleration energy.

FIG. 6 is a graph plotting the curves of the relative contributions of (a) the secondary emission from the target substrate 41, and (b) the hole-electron couples generated in the target substrate (and consequent conduction therein), to writing speed against the acceleration energy of the write beam in keV.

An inspection of this graph will reveal that the secondary emission from the target substrate 41 more or less contributes to writing speed at the beam acceleration energy of up to about only 3 keV. By contrast the contribution of the substrate conduction due to the hole-electron couples generated therein increases in direct proportion with the acceleration energy.

The secondary electrons are redistributed over the storage surface 59 when the beam acceleration energy exceeds the value corresponding to the value of the field mesh potential Vm (2300 V with respect to the cathode potential). The dashed line in FIG. 6 indicates this acceleration energy value. At the higher acceleration energy values, therefore, the curve a does not represent the contribution of secondary emission in the strict sense of the term.

The substrate conduction due to the hole-electron couples generated therein upon beam bombardment is a phenomenon peculiar sapphire or like monocrystalline insulators. The non- or polycrystalline substrates of conventional targets hardly exhibits this property. Thus, in contrast to the writing speed of several megahertz possessed by the conventional storage tubes, the writing speed of the scan converter storage tube incorporating the sapphire substrate is as high as 200 MHz.

For reading the charge pattern established on the storage surface 59 by writing, the movable contact 53 of the collector voltage selector switch 52 is actuated into engagement with the fixed contact 57. Thus connected to the collector electrode 42, the read mode power supply 51 applies thereto a voltage of, for example, −895 V (+5 V with respect to the cathode potential). The charge pattern can be read as the storage target 27 is scanned with an unmodulated read beam, as in a television set. The following is a more detailed description of the reading operation.

Let it be assumed that those regions of the storage surface 59 which have been struck by the write beam have a potential of −9 V with respect to the collector potential, and that the other substrate surface regions which have not been struck by the write beam have a potential of −10 V with respect to the collector potential. In the read mode the voltage applied to the collector electrode 42 from the read mode power supply 51 is further assumed as above to be −895 V (+5 V with respect to the cathode potential). Then the storage surface regions which have been bombarded by the write beam have a potential of −904 V (−4 V with respect to the cathode potential), whereas the other surface regions which have not been so bombarded have a potential of −905 V (−5 V with respect to the cathode potential).

The storage surface potential that inhibits the influx of the electron beam into the collector electrode 42 is now assumed to be set at −5 V with respect to the cathode potential. Then the read beam does not flow into those portions of the collector electrode 42 which adjoin the storage surface regions which have not been bombarded by the write beam and which therefore have the potential of −5 V with respect to the cathode potential. The read beam does flow into the other collector electrode portions which adjoin the storage surface regions which have been struck by the write beam and which have the potential of −4 V with respect to the cathode potential. It is thus possible to obtain from the collector electrode 42 the desired data output corresponding to the charge pattern that has been created on the storage surface 59 by selective bombardment thereof by the write beam.

The entire storage surface 59, including its regions which have been, and the other regions which have not been, bombarded by the write beam, has negative potentials, so that the influx of the electron beam into the target substrate 41 is restrained by virtue of the coplanar grid effect. Thus the charge pattern on the storage surface 59 is not destructed; in other words, the information is read out nondestructively.

EXAMPLE II

According to another example of the inventive method of erasing information in the scan converter storage tube of FIGS. 2 and 3, the movable contact 53 of the collector voltage selector switch 52 is moved into engagement with either the fixed contact 54 or 55 in the prime mode thereby connecting the storage target collector electrode 42 to either the prime mode power supply 48 or erase mode power supply 49. In this manner the potential Vc of the collector electrode 42 is set lower than the potential Vm (1400 V, or 2300 V with respect to the cathode potential) of the field mesh electrode 36 and at such a value that the potential Vs of the storage surface 59 with respect to the cathode potential Vk becomes higher than its first crossover potential Vl. That is, the collector potential Vc is so determined that the storage surface potential Vs is made greater than the sum of the cathode potential Vk and the first crossover potential Vl of the target substrate 41.

The storage surface potential Vs varies, of course, in step with the collector potential Vc. Thus, if a negative potential difference Vw (e.g., −10 V) due to the previously established charge pattern exists between collector electrode 42 and storage surface 59 before priming, then the collector potential Vc must be set so as to satisfy the relation, $Vk+Vl-Vw<Vc<Vm$.

Let it be assumed by way of example that the cathode potential Vk is −900 V, the first crossover potential Vl is 15 V, and the field mesh potential Vm is 1400 V. Then the collector potential Vc is set in the range of −875 to +1400 V, preferably −700 to +100 V (200 to 1000 V with respect to the cathode potential). The collector electrode 42 may be connected to the power supply 49 if a negative potential is to be applied to the collector electrode, and to the power supply 48 if a positive potential is to be applied.

Then, for priming, the complete storage surface 59 is subjected to raster scanning with the unmodulated electron beam, just as in a television set. Two consecutive cycles of raster scanning may be performed, with a target current of 0.1 or 0.2 microampere ($\mu$A).

In this prime mode preliminary to the erase mode the unmodulated beam strikes the storage surface 59 after its potential Vs with respect to the cathode potential Vk is made greater than the first crossover potential Vl. Moreover, since the field mesh potential Vm is higher than the collector potential Vc, the secondary electrons emitted from the storage surface 59 are captured by the field mesh electrode 36. The storage surface potential Vs thus becomes higher than the collector potential Vc by several tens of volts, up to about 100 V. The complete storage surface 59 uniformly assumes this potential upon being scanned with the prime beam.

Then, as the second step of erasure, the entire storage surface 59 is again bombarded by the unmodulated scanning beam. This time, however, the collector potential Vc is set lower than the cathode potential Vk and at such a value that the storage surface potential Vs with respect to the cathode potential becomes lower than the first crossover potential Vl. Symbolically, $Vc<Vk$, and $Vk<Vs<Vk+Vl$.

More specifically, in the second step of erasure, the movable contact 53 of the collector voltage selector switch 52 is set in engagement with the fixed contact 55 thereby connecting the collector electrode 42 to the erase mode power supply 49 via the potentiometer 58. With a potential of, for example, $-1000$ to $-950$ V ($-100$ to $-50$ V with respect to the cathode potential) thus applied to the collector electrode 42, the storage surface 59 is scanned with the unmodulated electron beam.

The storage surface potential Vs with respect to the cathode potential Vk is made less than the first crossover potential Vl in scanning the storage surface 59 with the unmodulated beam as above. The entire storage surface 59 thus acquires the cathode potential Vk as a result of the scanning, so that the storage surface potential Vs becomes higher than the collector potential Vc by 50 to 100 V.

Then, in order to create the prewrite potential difference Vpw between collector electrode 42 and storage surface 59, the collector potential Vc must be made higher than the cathode potential Vk without causing a corresponding increase in the storage surface potential Vs. If the desired prewrite potential difference is 10 V, for example, then the collector potential Vc may be increased to $-890$ V ($+10$ V with respect to the cathode potential Vk), and the storage surface potential Vs may be held equal to the cathode potential of $-900$ V. This is possible by the following method.

The increase of the collector potential Vc to $-890$ V is effected either continuously or in several steps while the storage surface 59 is undergoing repeated cycles of scanning with the unmodulated beam. The collector potential Vc must be increased at such a rate that on each scanning cycle, the storage surface potential Vs with respect to the cathode potential Vk is made less than the first crossover potential Vl of 15 V.

In this manner the storage surface potential Vs, which tends to increase with the collector potential Vc, is reduced to the cathode potential Vk by each scanning cycle. Ultimately, as the collector potential Vc reaches $-890$ V and as the storage surface potential Vs is once again reduced to the cathode potential of $-900$ V, the desired prewrite potential difference Vpw of 10 V is established between collector electrode 42 and storage surface 59.

The prewrite potential difference Vpw may be increased as desired to, for example, 20 V or more. It is self-evident that this is possible through the same procedure as above.

The foregoing second example of the inventive method also enables complete erasure of information from the storage target 27 whose substrate 41 is of sapphire or like monocrystalline insulator. Upon creation of the prewrite potential difference Vpw as above, the subsequent writing and reading operations may be carried out in the manner set forth in connection with the first example of the inventive method.

EXAMPLE III

What follows is still another example of the inventive method of erasing data in the scan converter storage tube of FIGS. 2 and 3. In the prime mode the movable contact 53 of the collector voltage selector switch 52 is actuated into engagement with either the fixed contact 54 or 55 thereby connecting the storage target collector electrode 42 to either the prime mode power supply 48 or the erase mode power supply 49.

The collector potential Vc is thus set lower than the potential Vm (1400 V, or 2300 V with respect to the cathode potential) of the field mesh electrode 36 and at such a value that the storage surface potential Vs with respect to the cathode potential Vk becomes higher than the first crossover potential Vl of the target substrate 41. That is, the collector potential Vc is so determined that the storage surface potential Vs is made higher than the sum of the cathode potential Vk and the first crossover potential Vl.

The storage surface potential Vs varies with the collector potential Vc. Thus, if a negative potential difference Vw of, for example, $-10$ V due to previously created charge pattern exists between collector electrode 42 and storage surface 59 before priming, then the collector potential Vc must be set so as to satisfy the relation, $Vk+Vl-Vw<Vc<Vm$.

Let it be assumed by way of example that the cathode potential Vk is $-900$ V, the first crossover potential Vl of the target substrate 41 is 15 V, and the field mesh potential Vm is 1400 V. Then the collector potential Vc is set in the range of $-875$ to $+1400$ V, preferably $-700$ to $+100$ V (200 to 1000 V with respect to the cathode potential). The collector electrode 42 may be connected by the collector voltage selector switch 52 to the erase mode power supply 49 if a negative potential is to be applied to the collector electrode, and to the prime mode power supply 48 if a positive potential is to be applied.

Then, for priming, the complete storage surface 59 is subjected to raster scanning with the unmodulated electron beam, as in a television set. Two consecutive cycles of raster scanning may be performed, with a target current of 0.1 to 0.2 $\mu$A.

In this prime mode, or the actual first step of erasing operation, the unmodulated electron beam bombards the storage surface 59 after its potential Vs with respect to the cathode potential Vk is made higher than the first crossover potential Vl. Moreover, since the field mesh potential Vm is higher than the collector potential Vc, the secondary electrons emitted from the storage surface 59 are captured by the field mesh electrode 36. Consequently the storage surface potential Vs becomes higher than the collector potential Vc by several tens of volts, up to about 100 V. Being uniformly scanned with the unmodulated beam, the complete storage surface 59 acquires the same potential.

Then, as the second step of erasing operation, the collector electrode 42 is connected to the potentiometer 58 by the collector voltage selector switch 52 and is thereby applied with the potential Vc that satisfies the relation, $Vk<Vc<Vk+Vl$. This collector potential Vc may be, for example, −890 V (+10 V with respect to the cathode potential). Also the field mesh potential Vm is lowered from its previously assumed value of 1400 V by several hundred volts or more (e.g., 1000 V).

In this manner the storage surface potential Vs is also lowered through capacitive coupling with the field mesh electrode 36 thereby satisfying the relation, $Vk<Vs<Vk+Vl$. Under this condition the storage surface 59 is subjected to several consecutive cycles of scanning with the unmodulated beam.

In the storage target 27 constructed as in FIG. 3 and having its storage surface 59 disposed opposite to the field mesh electrode 36, capacitance exists between storage surface and field mesh electrode. Thus, when the field mesh potential Vm is decreased as above, the storage surface potential Vs also decreases through the capacitive coupling, to such an extent as to satisfy the relation, $Vk<Vs<Vk+Vl$.

In the above second step of erasure, therefore, the storage surface 59 undergoes the several scanning cycles after having its potential Vs made less, with respect to the cathode potential Vk, than the first crossover potential Vl. Consequently the storage surface 59 assumes the cathode potential as a result of the scanning. The desired prewrite potential difference Vpw of about 10 V is now created between collector electrode 42 and storage surface 59.

The field mesh potential Vm must be returned to the initial value in the course of the above scanning cycles. The storage surface potential Vs may temporarily increase with the return of the field mesh potential Vm to its initial value, through the noted capacitive coupling, but can be reduced to the cathode potential by the subsequent scanning cycle or cycles. If desired the field mesh potential Vm may be returned to the former value during a break in the successive scanning cycles.

If the storage surface potential Vs with respect to the cathode potential Vk remains less than the first crossover potential Vl after the field mesh potential Vm is returned as above to the former value, the storage surface 59 will gain the cathode potential when scanned subsequently.

In order to make the prewrite potential difference Vpw higher, the collector potential Vc may be increased while the storage surface 59 is being subjected to a cycle or cycles of scanning with the unmodulated beam. The collector potential Vc must be increased only to such an extent at one time that the storage surface potential Vs with respect to the cathode potential Vk is less than the first crossover potential Vl. Since then the storage surface 59 acquires the cathode potential Vk upon completion of each scanning cycle, the desired higher prewrite potential difference can be realized. The subsequent steps of writing and reading can be conducted in the manner explained in connection with the first example of the inventive method.

EXAMPLE IV

Figure 7:
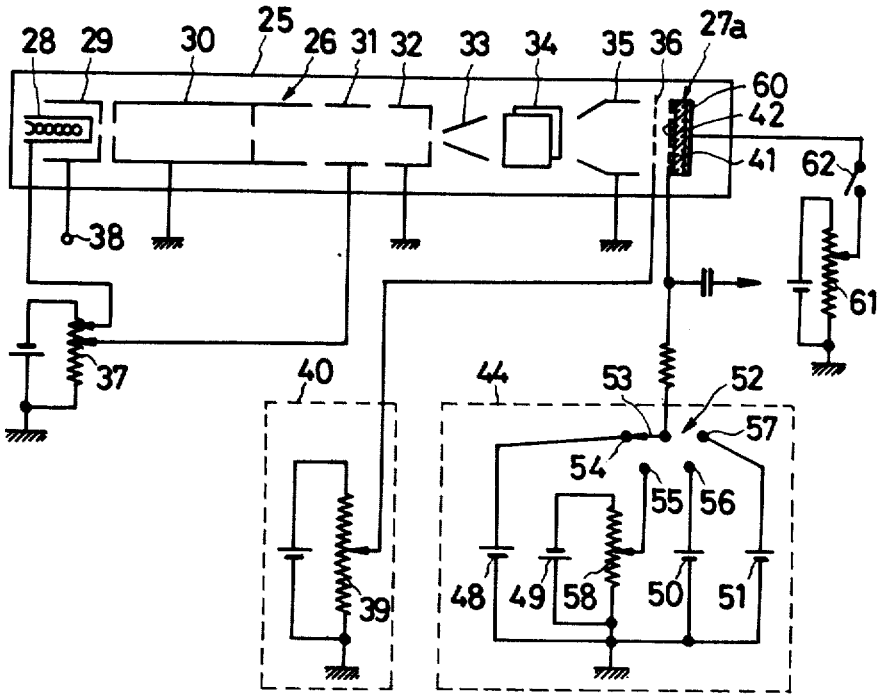
FIG. 7 is a schematic axial sectional view of another example of scan converter storage tube for use with the method of our invention.

The fourth example of the inventive method is directed to a scan converter storage tube of slightly modified configuration shown in FIG. 7. The modification resides in a backing electrode 60 in the form of a metal film closely contacting the rear surface of the target substrate 41. The backing electrode 60 is electrically connected to a potentiometer 61 via a switch 62. The storage target including this backing electrode 60 is generally designated **27*a*. The storage tube of FIG. 7 is identical in the other structural details with that of FIGS. 2 and 3, so that the various parts of the FIG. 7 storage tube will be identified by the same reference numerals as used to denote the corresponding parts of FIGS. 2 and 3** storage tube, and the description of such corresponding parts will be omitted.

For erasing information in the storage tube of FIG. 7, the collector voltage selector switch 52 is actuated in the prime mode to connect the collector electrode 42 of the storage target **27*a* to either the prime mode power supply 48 or the erase mode power supply 49. The collector potential Vc is thus set lower than the field mesh potential Vm (1400 V, or 2300 V with respect to the cathode potential) and at such a value that the storage surface potential Vs with respect to the cathode potential Vk becomes higher than the first crossover potential Vl of the target substrate 41**. That is, the collector potential Vc is so determined that the storage surface potential Vs is made higher than the sum of the first crossover potential Vl and cathode potential Vk.

The storage surface potential Vs varies in step with the collector potential Vc. Therefore, if a negative potential difference Vw of, for example, −10 V due to the previously created charge pattern exists between collector electrode 42 and storage surface 59 prior to priming, then the collector potential Vc must be set so as to satisfy the relation, $Vk+Vl-Vw<Vc<Vm$.

Let it be assumed by way of example that the cathode potential Vk is −900 V, the first crossover potential Vl is 15 V, and the field mesh potential Vm is 1400 V. Then the collector potential Vc is set in the range of −875 to +1400 V, preferably −700 to +100 V (200 to 1000 V with respect to the cathode potential). The collector electrode 42 may be connected by the collector voltage selector switch 52 to the erase mode power supply 49 if a negative potential is to be applied to the collector electrode, and to the prime mode power supply 48 if a positive potential is to be applied.

Then the complete storage surface 59 is subjected to raster scanning with the unmodulated electron beam, as in a television set. Two consecutive cycles of raster scanning may be applied, with a target current of 0.1 or 0.2 μA.

In this prime mode, or the actual first step of erasing operation, the unmodulated beam bombards the storage surface 59 after its potential Vs with respect to the cathode potential Vk is made greater than the first crossover potential Vl. Moreover, since the field mesh potential Vm is higher than the collector potential Vc, the secondary electrons emitted from the storage surface 59 are captured by the field mesh electrode 36. Consequently the storage surface potential Vs becomes higher than the collector potential Vc by several tens of volts, up to about 100 V. Being uniformly scanned with the prime beam, the entire storage surface 59 assumes the same potential. In this prime mode the backing electrode 60 may be held connected to the potentiometer 61 to be thereby applied with, for example, the same potential as the collector electrode 42.

Then, as the second step of erasing operation, the collector potential Vc is set at a value that satisfies the relation, $Vk < Vc < Vk + Vl$. This collector potential value may be, for example, −890 V (+10 V with respect to he cathode potential). Also the potential Vb applied to the backing electrode 60 is made lower than its value in the prime mode by, for example, 100 V.

Figure 8:
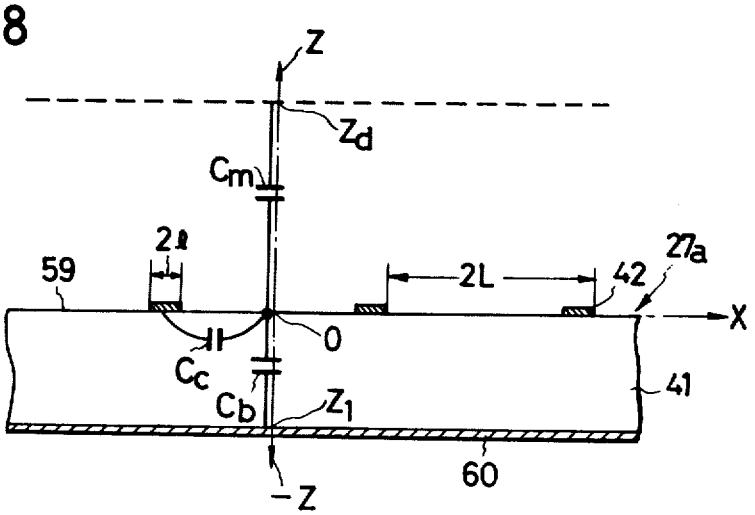
FIG. 8 is a fragmentary, enlarged sectional view of the storage target used in the scan converter storage tube of FIG. 7.

Consequently, by virtue of the capacitive coupling due to the capacitance Cb given in FIG. 8, the storage surface potential Vs with respect to the cathode potential Vk becomes less than the first crossover potential Vl. There is thus obtained the storage surface potential Vs that satisfies the relation, $Vk < Vs < Vk + Vl$. Under this condition the storage surface 59 is subjected to several cycles of scanning with the unmodulated beam, with the result that the surface assumes the cathode potential Vk. The desired prewrite potential difference Vpw of 10 V is now established between collector electrode 42 and storage surface 59.

The backing electrode potential Vb may be returned, during the progress of the above scanning cycles, to the same potential as the collector electrode 42 or to a potential such that the above prewrite potential difference can be maintained. The backing electrode potential Vb may be returned to the desired values during a break in the successive scanning cycles.

If the storage surface potential Vs with respect to the cathode potential Vk remains less than the first crossover potential Vl after the backing electrode potential Vb is returned as above to the desired values, the storage surface 59 will assume the cathode potential when scanned subsequently. The application of a negative potential to the backing electrode 60 is possible simply by reversing the polarity of the power supply included in the potentiometer 61.

In order to make the prewrite potential difference Vpw higher, the storage surface 59 may be subjected to an additional cycle or cycles of scanning with the unmodulated beam, with the collector potential Vc increased only to such an extent at one time that the consequent storage surface potential Vs with respect to the cathode potential Vk is less than the first crossover potential Vl of the target substrate 41. As the storage surface potential Vs becomes equal to the cathode potential Vk upon completion of each scanning cycle, the desired higher prewrite potential difference Vpw can be realized between collector electrode 42 and storage surface 59.

The subsequent steps of writing and reading can be performed through the procedure set forth in connection with the first example of the inventive method. In these steps the backing electrode 60 may be held disconnected from the potentiometer 61 by opening the switch 62 or, alternatively, may be held applied with a voltage higher than the collector potential Vc by, for example, 200 V.

A more detailed description of the capacitive couplings involved in the storage target **27*a* of FIG. 7 will now be given with reference to FIG. 8. The collector electrode 42 of the storage target 27*a* is assumed to be in the form of parallel spaced stripes, each having a constant width 2l and constantly spaced from each other with a pitch 2L. The thickness of the collector electrode 42**, which may be about 0.1 μm, will be neglected for the purposes now in question.

The above collector stripes are now assumed to extend parallel to the Y axis which is normal to the plane of the drawing sheet. The X axis indicates the direction extending normal to the collector stripes. The Z axis extends normal to the plane of the storage surface 59. O indicates the origin located at the midpoint between any two adjacent collector stripes. The target substrate 41 has a thickness Z1; that is, the backing electrode 60 is spaced Z1 from the storage surface 59. The field mesh electrode 36 is distanced Zd from the storage surface 59.

The geometry of the storage target **27*a* having been determined as in the foregoing, the capacitance distribution C(x) in the X direction of the storage surface 59** can be defined as:

$$C(x) = -\frac{1}{2L}(1+\epsilon_s)\epsilon_o\left\{\tan\frac{\pi}{2}\left(1-\frac{1}{L}(x+l)\right)-\tan\frac{\pi}{2}\left(1-\frac{1}{L}(x-l)\right)\right\}+\epsilon_o\left(1-\frac{l}{L}\right)\frac{\epsilon_s}{Z1}+\epsilon_o\left(1-\frac{l}{L}\right)\frac{1}{Zd}$$

where $\epsilon_s$ is the effective dielectric constant of the target substrate 41, and $\epsilon_o$ is the dielectric constant of vacuum.

The first term on the right hand side of the above equation represents the capacitive coupling Cc between storage surface 59 and collector electrode 42. The second term represents the capacitive coupling Cb between storage surface 59 and backing electrode 60. The third term represents the capacitive coupling Cm between storage surface 59 and field mesh electrode 36.

It is to be noted that on the storage surface 59, the total degree of the capacitive couplings depends on the distance along the X axis from the origin O. Thus, as the electrodes 36, 42 and 60 are set at certain potentials, the storage surface potential Vs varies as a function of the distance along the X axis. The same holds true with the storage target 27 except that it has no capacitive coupling Cb. Although the storage surface potential Vs has been dealt with hereinbefore as though it had some definite values, these should be interpreted as mean effective values.

The storage surface potential Vs is also subject to change depending upon the shape of the collector electrode 42, which is not necessarily in the form of stripes. For this reason, too, the various specified values of the storage surface potential Vs should be taken as mean effective ones. While the previous capacitance distribution formula derives from the particular target configuration of FIG. 8, the degrees of capacitive couplings depend greatly upon the geometry of the target in use. In the practice of the inventive method, therefore, the various operating values may be determined in consideration of the foregoing.

It is understood that our invention is not to be restricted by the exact showing of the accompanying drawings or the description thereof, since numerous changes or modifications will readily occur to those skilled in the art. For instance, the first, second and third examples of the inventive method, described in connection with the scan converter storage tube of FIG. 2, are applicable to that of FIG. 7 as well. The inventive method also finds use with storage tubes of other than the illustrated configurations, such as the one deriving various required potentials from a single power supply. Electron lenses or like additional devices may also be incorporated in the storage tubes for use with our invention. All these and other modifications or changes within the usual knowledge of the specialists are considered to fall within the scope of the following claims.

We claim:

1. In a scan converter storage tube of the type having an electron gun of an electrostatic focus and deflection variety for generating a modulated or unmodulated electron beam, the electron gun including a cathode and a field mesh electrode, and a storage target to be scanned by the electron beam from the electron gun, the storage target including a substrate fabricated from a single crystal of insulating material, the substrate having a storage surface which is disposed opposite to the field mesh electrode of the electron gun and which has formed thereon a collector electrode having a plurality of regularly patterned openings formed therein, a method of erasing information from the storage target which comprises:

(a) setting the potentials of the field mesh electrode and the collector electrode at such relative values that the potential (Vc) of the collector electrode is higher than the value which is lower than the potential (Vm) of the field mesh electrode by up to about 100 volts;

(b) causing the electron gun to scan the storage surface of the substrate with the unmodulated electron beam while the potentials (Vm, Vc) of the field mesh electrode and the collector electrode are set as in step (a);

(c) setting the potential (Vc) of the collector electrode higher than the potential (Vk) of the cathode and at such a value that the potential (Vs) of the storage surface with respect to the potential (Vk) of the cathode is made less than a first crossover potential (Vl) at which the secondary emission ratio of the substrate first becomes unity; and (d) causing the electron gun to scan the storage surface of the substrate with the unmodulated electron beam while the potential (Vc) of the collector electrode is set as in step (c).

2. The erasing method as recited in claim 1, wherein in step (a) the potential (Vc) of the collector electrode is set higher than the potential (Vm) of the field mesh electrode.

3. The erasing method as recited in claims 1 or 2, which further comprises:

(e) following step (d), increasing the potential (Vc) of the collector electrode to such an extent that the potential (Vs) of the storage surface with respect to the potential (Vk) of the cathode is less than the first crossover potential (Vl) of the substrate; and (f) causing the electron gun to scan the storage surface of the substrate with the unmodulated electron beam while the potential (Vc) of the collector electrode is set as in step (e).

4. In a scan converter storage tube of the type having an electron gun of an electrostatic focus and deflection variety for generating a modulated or unmodulated electron beam, the electron gun including a cathode and a field mesh electrode, and a storage target to be scanned by the electron beam from the electron gun, the storage target including a substrate fabricated from a single crystal of insulating material, the substrate having a storage surface which is disposed opposite to the field mesh electrode of the electron gun and which has formed thereon a collector electrode having a plurality of regularly patterned openings formed therein, a method of erasing information from the storage target which comprises:

(a) setting the potential (Vc) of the collector electrode lower than the potential (Vm) of the field mesh electrode and at such a value that the potential (Vs) of the storage surface with respect to the potential (Vk) of the cathode is made higher than a first crossover potential (Vl) at which the secondary emission ratio of the substrate first becomes unity;

(b) causing the electron gun to scan the storage surface of the substrate with the unmodulated electron beam while the potential (Vc) of the collector electrode is set as in step (a);

(c) setting the potential (Vc) of the collector electrode lower than the potential (Vk) of the cathode and at such a value that the potential (Vs) of the storage surface with respect to the potential (Vk) of the cathode is made lower than the first crossover potential (Vl) of the substrate;

(d) causing the electron gun to scan the storage surface of the substrate with the unmodulated electron beam while the potential (Vc) of the collector electrode is set as in step (c);

(e) increasing the potential (Vc) of the collector electrode to such an extent that the potential (Vs) of the storage surface with respect to the potential (Vk) of the cathode remains less than the first crossover potential of the substrate;

(f) causing the electron gun to scan the storage surface of the substrate with the unmodulated electron beam after the potential (Vc) of the collector electrode is increased as in step (e); and (g) repeating the steps (e) and (f) until the potential (Vc) of the collector electrode becomes higher than the potential (Vk) of the cathode.

5. In a scan converter storage tube of the type having an electron gun of an electrostatic focus and deflection variety for generating a modulated or unmodulated electron beam, the electron gun including a cathode and a field mesh electrode, and a storage target to be scanned by the electron beam from the electron gun, the storage target including a substrate fabricated from a single crystal of insulating material, the substrate having a storage surface which is disposed opposite to the field mesh electrode of the electron gun and which has formed thereon a collector electrode having a plurality of regularly patterned openings formed therein, a method of erasing information from the storage target which comprises:

(a) setting the potential (Vc) of the collector electrode lower than the potential (Vm) of the field mesh electrode and at such a value that the potential (Vs) of the storage surface with respect to the potential (Vk) of the cathode is made higher than a first crossover potential (Vl) at which the secondary emission ratio of the substrate first becomes unity;

(b) causing the electron gun to scan the storage surface of the substrate with the unmodulated electron beam while the potential (Vc) of the collector electrode is set as in step (a);

(c) making the potential (Vs) of the storage surface higher than the potential (Vk) of the cathode and, with respect to the potential (Vk) of the cathode, lower than the first crossover potential (Vl) by setting the potential (Vc) of the collector electrode with respect to the potential (Vk) of the cathode lower than the first crossover potential (Vl) and by setting the potential (Vm) of the field mesh electrode lower than its value in steps (a) and (b); and (d) causing the electron gun to scan the storage surface of the substrate with the unmodulated electron beam while the potential (Vc) of the collector electrode and the potential (Vm) of the field mesh electrode are set as in step (c).

6. In a scan converter storage tube of the type having an electron gun of an electrostatic focus and deflection variety for generating a modulated or unmodulated electron beam, the electron gun including a cathode and a field mesh electrode, and a storage target to be scanned by the electron beam from the electron gun, the storage target including a substrate fabricated from a single crystal of insulating material, the substrate having two opposite surfaces one of which is a storage surface disposed opposite to the field mesh electrode of the electron gun, the storage target further including a collector electrode on the storage surface of the substrate and a backing electrode on the other surface of the substrate, the collector electrode having a plurality of regularly patterned openings formed therein, a method of erasing information from the storage target which comprises:

(a) setting the potential (Vc) of the collector electrode lower than the potential (Vm) of the field mesh electrode and at such a value that the potential (Vs) of the storage surface with respect to the potential (Vk) of the cathode is made higher than a first crossover potential (Vl) at which the secondary emission ratio of the substrate first becomes unity;

(b) causing the electron gun to scan the storage surface of the substrate with the unmodulated electron beam while the potential (Vc) of the collector electrode is set as in step (a);

(c) making the potential (Vs) of the storage surface higher than the potential (Vk) of the cathode and, with respect to the potential (Vk) of the cathode, lower than the first crossover potential (Vl) by setting the potential (Vc) of the collector electrode with respect to the potential (Vk) of the cathode lower than the first crossover potential (Vl) and by setting the potential (Vb) of the backing electrode lower than its value in steps (a) and (b); and (d) causing the electron gun to scan the storage surface of the substrate with the unmodulated electron beam while the potential (Vc) of the collector electrode and the potential (Vb) of the backing electrode are set as in step (c).

* * * * *